United States Patent [19]

Lewis

[11] 4,128,094

[45] Dec. 5, 1978

[54] HEATER

[76] Inventor: Oscar D. Lewis, 1963 19th Ave. Ct., NW., Hickory, N.C. 28601

[21] Appl. No.: 839,754

[22] Filed: Oct. 5, 1977

[51] Int. Cl.[2] ..... F24H 3/08

[52] U.S. Cl. ..... 126/110 B; 126/61; 126/72

[58] Field of Search ..... 126/110 B, 109, 121, 126/72, 61, 63, 66, 67, 391, 392; 110/308

[56] References Cited

U.S. PATENT DOCUMENTS

| | | | |
|---|---|---|---|
| 585,027 | 6/1897 | Gurney | 126/72 |
| 752,068 | 2/1907 | Hampden | 26/109 |
| 1,394,741 | 3/1920 | Dundon | 126/109 X |
| 2,283,407 | 5/1942 | Bassett et al. | 126/109 X |
| 2,672,108 | 3/1954 | Arnold | 431/173 X |
| 3,598,090 | 8/1971 | Smith | 110/308 X |

*Primary Examiner*—William F. O'Dea
*Assistant Examiner*—William E. Tapolcai, Jr.

[57] ABSTRACT

Disclosed is a means for heating a space with hot air comprising essentially first and second enclosures, the second enclosure being completely surrounded by and spaced apart from the first enclosure to form an air chamber for the circulation and heating of air. Energy for heating the air is supplied by burning fuel (wood, coal, etc.) disposed on a plurality of spaced apart, grate forming, tubelike members lying in a common plane positioned inside of the second enclosure. A terminal portion of one end of the tubes bridge across the air chamber and the tubes terminal edges are exposed to the space sought to be heated; terminal edges of the other end of the tubes are exposed to and communicate with the air chamber. In combination with the above, there is a blower means adapted to supply air to the air chamber and to circulate such air through the bottom portion of the air chamber, across the terminal portion of the tubes bridging the air chamber and then throughout the balance of the chamber, while receiving heat energy from the fuel combusting inside of the second enclosure, until such air impinges upon a baffle located just below where the terminal edges of the tubes communicate with the air chamber and is heated further as it is forced through the tubes and out into the space desired to be heated.

3 Claims, 3 Drawing Figures

HEATER

BACKGROUND OF THE INVENTION

1. Field of the Invention

The present invention relates to household type space heaters adapted to burn most any kind of solid fuel locally available, more particularly wood and/or coal. For the past several years, there has been a popular trend to find a more economical means of heating family residences. With the advent of fuel oil, natural gas, and electrical power becoming more and more expensive, many single and multifamily residences have installed stoves that burn a more readily available fuel and produces heat energy cheaper than that obtainable from public utilities (natural gas, electricity, and fuel oil). The most popular and pervasive of these types of stoves is the old fashion wood burning stove.

Many families have attempted to use a fireplace as a means to supplement their heating requirements and reduce heating cost, only to rediscover the many drawbacks of a fireplace, known only to well to most of the population during colonial times. Simply stated, a fireplace is grossly inefficient, having only a ten to twenty percent effective use of the heat created by the combustion of the wood or coal, the balance being exhausted up the chimney. Furthermore, a fire in a fireplace needs closer attention than one in an enclosed stove or heater, in order to keep sparks from bursting out into the room and causing the unwanted fire to rugs, furniture, clothes, and the like.

An optimum and desirable wood burning stove would not only heat an area approximately two thousand square feet or more but also would do so with a minimum amount of fuel and with a maximum amount of safety. The instant invention accomplishes these desirable goals by providing a chamber in which combustion takes place, completely enclosed and safe so that it can be left unattended with absolute piece of mind. Furthermore, the instant invention has a design that produces a surprising efficiency, such efficiency being a function of the combination of a controlled system in which air is heated. Outside supply air is circulated throughout an air chamber, which completely surrounds the combustion area, where it is first heated. The thus heated air is further heated by being forced through a plurality of pipes (conduits), which form a grate upon which the combustion material is positioned. The heated air is ultimately discharged from such pipes into the space desired to be heated.

2. Summary of the Invention

Disclosed is a hot air heater comprising a first enclosure completely surrounded and spaced apart from a second enclosure, the enclosures positioned in relation to one another to form an air chamber between them. The second enclosure has disposed in it a plurality of conduits (tubes), positioned in a spaced apart relationship one to another and lying in a common plane, there being aligned holes in the first and second enclosures equal in number to the conduits and adapted to receive and receiving terminal portions of the tubes. These terminal portions bridge across the air chamber and may be attached to the first and second enclosures. The second enclosure has additional number of like holes, also adapted to receive and receiving the other terminal portion of the conduits are open to and are in communication with the air chamber. The terminal edge of the other terminal portion of the conduits are open to and in communication with a space that is desired to be heated. A baffle means is located between the first and second enclosures at a position just below where the terminal edges of the conduits are in communication with the air chamber. Located below the baffle means is a means for supplying outside air to the air chamber and circulating the air through the bottom portion of the air chamber, across the terminal portions of the conduits bridging the air chamber, throughout the balance of the chamber until it strikes the baffle and is diverted into the conduits in communication with the chamber, through the conduits (underneath the fuel being combusted) and thence to the outside space that is desired to be heated. Throughout this path the air is heated and is exposed to increasingly higher temperatures, the highest temperature being that of the tubes.

DESCRIPTION OF THE PREFERRED EMBODIMENT

Figure 1:
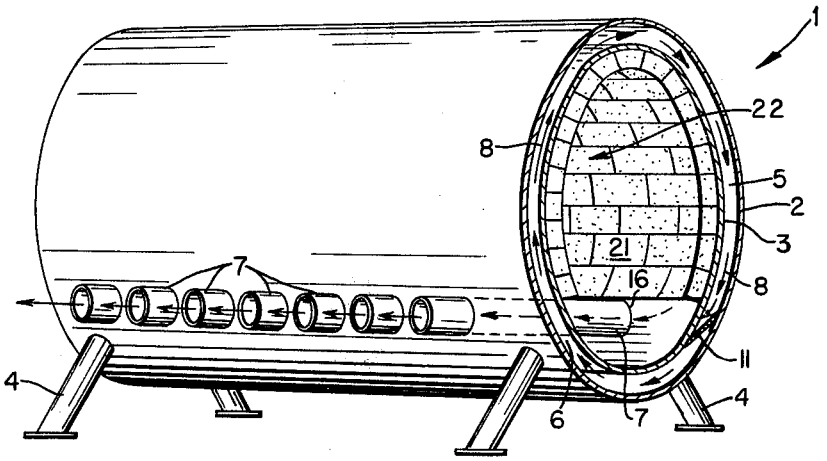
FIG. 1 is a schematic diagram of the space heater.
Figure 2:
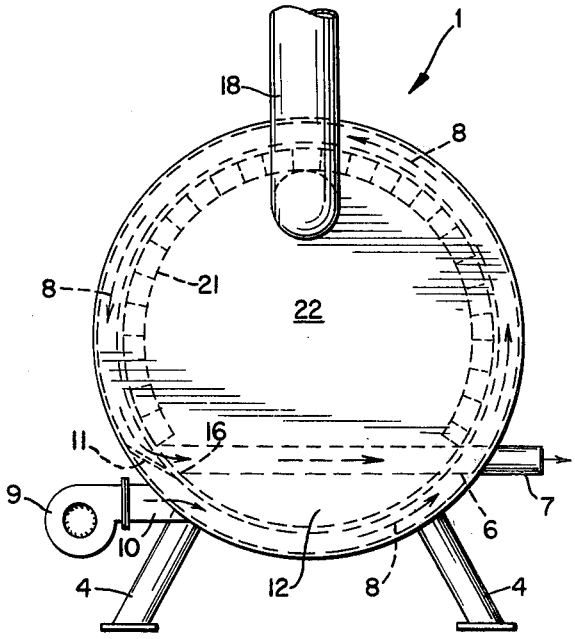
FIG. 2 is a cross sectional view of the rear of the space heater.

In the schematic diagram of FIG. 1, the invention is generally indicated as element 1. The first chamber, element 2, encloses a second chamber 3 nested inside of and spaced apart from the first forming an air passageway therebetween 5. The interior of chamber 3 serves as a combustion chamber in which there is disposed a plurality of conduits or pipes 7, all of which lie in a common plane. Conduits 7 are supported by their being received in appropriate aligned holes in chambers 2 and 3 as shown, with a terminal portion 6 of conduit 7 bridging chamber 5. Conduits 7 may have terminal portions that pertrude beyond the outermost surface of outer chamber 2. In any event, conduits 7 have a terminal edge open to and in communication with that space that is desired to be heated by the stove. Alternatively, the terminal edge of conduit 7 can be flush with the outermost surface of enclosure 2 (not shown). The other terminal edge of conduit 7, shown by element 16 in FIG. 2, is open and in communication with air chamber 5, adapted to receive air flowing in the manner indicated by the arrows 8 (FIGS. 1 and 2, and to channel such air through conduits 7 and out into the space desired to be heated. Just below where conduits 7 communicate with chamber 5 at their terminal edges 16, there is disposed throughout the length of chamber 5, baffle 11. The purpose of such baffle is to divert the circulating air, after it has traveled around the full length of chamber 5, into conduits 7 and thence to the space desired to be heated. Air from outside of the heater is brought in by blower means 9 through conduit 10, which is in communication with chamber 5, and is forced into the bottom portion of chamber 5, across exposed bridging terminal portions 6 of conduits 7, thence throughout the balance of chamber 5 until it strikes baffle 11, at which point the air is diverted into openings 16 of conduit 7 and thence through conduits 7 to the space to be heated.

Combustable material such as coal, wood, etc. (not shown) are disposed on top of conduits 7, the fuel ignited and burned at that location, the ashes from same dropping down between conduits 7, which are spaced apart an optimum distance for the intended fuel. The ashes from combustion are collected in the bottom portion of enclosure 3 at that portion indicated by element 12. Combustion gases by convection rise and are exhausted from the stove through a flue 18 in a manner well known.

Figure 3:
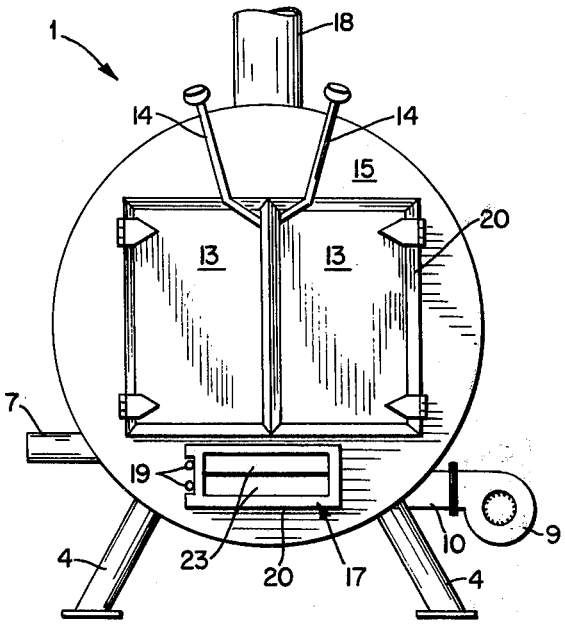
FIG. 3 is a front elevation of the front of the space heater.

Referring to FIG. 3, element 13 identifies two swinging doors attached in a hinged manner to end member 15 of the stove and adapted to snuggly fit together to prevent combusting gases and ashes from escaping. Attached to the doors are handle means 14, used to open and close the doors. End member 15 is welded to chambers 2 and 3 in a manner well known in the art. An appropriate end member (not shown) is also provided for the opposite end of the heater, having a hole therein to accommodate flue member 18 so that the combustion chamber 22 is in communication with the flue.

Located below doors 13 are two damper means 23 (an upper and a lower). These damper means or doors are disposed in a slidable fashion, well known in the art, within damper bracket 17. Attached to damper means 23 are knobs 19, which are used to slide them to a left or right position, thereby permitting outside air to enter beneath the conduit means 7 and supply sufficient oxygen for combustion of the fuel (not shown) disposed on conduits 7. Of course, it will be recognized that damper means 23 are used to control the rate of combustion and thus achieving an economy of fuel and maximizing of the amount of heat derived. Ashes can be readily removed through the opening controlled by damper means 23. The entire stove is mounted on legs 4 and the interior of enclosure 3 above conduits 7 is lined with firebrick or other refractory substance 21.

In summation, the disclosed invention is a stove adapted to burn wood or coal, constructed in a manner so that air can be blown completely around a fire box (combustion chamber) and then forced through conduits or pipes which are disposed in the fire box, the conduits serving as grates and as a supporting means for the fuel being combusted. Outside air that is to be heated enters into an air space formed between first and second enclosures, first travels underneath the grate and then up over the top of the fire box or combustion chamber and thence down to a baffle, which diverts the thus heated air into the conduits and then into the space to be heated. Such an arrangement keeps the air moving towards progressively hotter portions of the heater until it makes its exit into the area desired to be heated.

Chamber or enclosure 3 can be made from ¼ inch steel plate rolled to an outside diameter of 24 inches and can be, for example, 30 inches in length. Outside enclosure or chamber 2 can be made from ⅛ inch steel plate rolled to an outside diameter of 29 inches and also 30 inches in length. By disposing chamber 3 inside of chamber 2 and using such dimensions, a 2½ inch air space 5 is created.

Two end members (end plates) one for the back and one for the front, see element 15 in FIG. 3, may be made from ¼ inch steel plates. By reversing the end members 15 at the time of construction, the orientation of the stove can be made, i.e. it can be either a left handed or right handed stove — air can be made to exit on the left or right hand side of the stove as desired.

With respect to conduits 7, such can be made from 2 inch inside diameter pipes which are butted against and welded to one inside wall, namely chamber 3, and run through the fire box (chamber 3), bridging both chambers. Such pipes can also be welded where they contact chambers 2 and 3 in a manner well known in the art. Conduits 7 are used for the final heating of the air and also for the most intense heating and conduits 7 also serve as grates (supporting means) for the fuel as it is being combusted.

Blower means 9 can be used in combination with a thermostat programmed to sense the temperature in the space sought to be heated and activated when heat is needed and deactivated when a desired temperature has been reached. A variable speed blower can be also used in such a combination.

Doors 23 and 13 can be made of ¼ inch steel plate framed with angle iron 20. The door opening is also framed with angle iron to provide a tight fit. Draft and ash removing doors 23 are constructed of ⅛ inch steel plate, one sliding on the other, which by sliding the top section, the draft can be controlled. By sliding both doors, an access way is created from which ashes can be removed with a minimum of effort.

With respect to firebrick 21, either one or two layers of firebrick can be used and can be supported on conduits 7, it being recommended that three layers of firebrick be used in the rear of the stove. By use of firebrick, a fire can be held up to 36 hours with surprising ease.

I claim:

1. A hot air heater comprising: first and second enclosures, said first enclosure having a set of holes and said second enclosure having a first and second set of holes, the first set being aligned with and located opposite from said second set, said first enclosure completely surrounding and spaced apart from said second enclosure forming an air chamber therebetween, the enclosures being positioned relative to one another so that the holes of said first enclosure are in alignment with at least one set of holes of said second enclosure; a plurality of conduits disposed in said enclosures, positioned in a spaced apart relationship one to another in a common plane and received in said holes so that terminal portions of one end of said conduits bridge said air chamber and are in open communication with the outside air and their opposite ends are in communication with said air chamber; baffle means disposed in said air chamber for diverting air moving in said chamber into said conduits; and, a blower means in communication with said air chamber for circulating air from outside of the heater through the bottom portion of said air chamber, across the bridging portions of said conduits, through the balance of said air chamber, through said conduits and thence into a space desired to be heated.

2. A hot air heater as described in claim 1 wherein at least a portion of the innermost surface of said second enclosure, apart from that space occupied by said conduits, is lined with a refractory substance.

3. A hot air heater as described in claim 1 wherein said blower means is in pneumatic communication with said air chamber between said baffle and conduit portions disposed bridging said first and second enclosures.

* * * * *